US010655360B1

(12) United States Patent
Desilets

(10) Patent No.: US 10,655,360 B1
(45) Date of Patent: May 19, 2020

(54) DOOR HANDLE AND METHOD FOR USE

(71) Applicant: Brian Desilets, Simpsonville, KY (US)

(72) Inventor: Brian Desilets, Simpsonville, KY (US)

( * ) Notice: Subject to any disclaimer, the term of this patent is extended or adjusted under 35 U.S.C. 154(b) by 335 days.

(21) Appl. No.: 15/682,055

(22) Filed: Aug. 21, 2017

(51) Int. Cl.

| | |
|---|---|
| ***E05B 3/04*** | (2006.01) |
| ***E05B 79/06*** | (2014.01) |
| ***E05C 1/14*** | (2006.01) |
| *E05B 15/00* | (2006.01) |

(52) U.S. Cl.
CPC ..... *E05B 3/04* (2013.01); *E05B 79/06* (2013.01); *E05C 1/14* (2013.01); *E05B 15/00* (2013.01)

(58) Field of Classification Search
CPC ..... E05B 3/04; E05B 3/00; E05B 3/10; E05B 79/06; E05B 15/00; E05C 1/14; E05C 1/10; E05C 1/12; Y10T 16/44; Y10T 16/46; Y10T 16/462; Y10T 16/444
USPC ..... 292/336.3
See application file for complete search history.

(56) References Cited

U.S. PATENT DOCUMENTS

| | | | | |
|---|---|---|---|---|
| 3,935,787 | A * | 2/1976 | Fisher | E05B 1/0015 411/16 |
| 4,044,809 | A * | 8/1977 | Guerrico Echevarria | F16B 37/0864 411/276 |
| 2008/0018127 | A1* | 1/2008 | Schindler | B29C 45/14639 296/1.02 |
| 2015/0375451 | A1* | 12/2015 | Voris | B29C 67/0055 264/78 |

* cited by examiner

*Primary Examiner* — Nathan Cumar
(74) *Attorney, Agent, or Firm* — Middleton Reutlinger

(57) ABSTRACT

A door handle assembly and a method relating to using the door handle assembly are disclosed herein. In various embodiments, the door handle assembly include a grasping area and a securing area. The securing area may include a plurality of apertures, wherein each of the plurality of apertures has one or more flanges. The one or more flanges may be pliable and retain a removable securing device. The door handle may be made using injection molded plastics. The method of using the door handle assembly may provide a ready to use door handle assembly with the door handle having pre-inserted removable securing devices ready to be assembled to a door.

14 Claims, 7 Drawing Sheets

DOOR HANDLE AND METHOD FOR USE

CROSS-REFERENCE TO RELATED APPLICATIONS

None.

TECHNICAL FIELD

Generally, a door handle assembly and a method for using the door handle assembly is taught.

BACKGROUND

A typical door may range from 78" to 80" in height and 30" to 36" in width. These doors may be, but are not limited to, hinged doors, sliding doors, and/or rotating doors. In the manufacturing process, after a door is made, temporary door handles are attached to the door and remain in place until the door is installed in a residential home or a commercial building. These temporary door handles allow the manufacturer or installer to easily move the door around by grasping the temporary door handles to lift and maneuver the door rather than grasping the edges 36" apart to lift and maneuver the door.

Installing these temporary door handles is a time-consuming, tedious process that involves removing a temporary door handle from a box, locating a plurality of screws and/or other fastening devices, placing the temporary door handle in a desired position on the door, inserting the plurality of screws and/or other fastening devices in the temporary door handle, and securing the temporary door handle to the door. This usually requires a manufacturer to work in a cluttered area surrounded by power tools and various boxes of parts including a box of temporary door handles, a box of screws and/or other fastening devices. Additionally, screws and/or other fastening devices often end up on the floor which may create an unnecessary man-made safety hazard for manufacturers working in the area. This process of removing, locating, placing, inserting, and securing each temporary door handle with the plurality of screws and/or other fastening devices wastes both time and materials.

There is a need in the art for further reducing the waste of both time and materials.

SUMMARY

Generally, a door handle assembly is taught. The door handle assembly has a grasping surface and a securing area. The securing area has a top surface, a bottom surface, and a plurality of apertures. Each of the apertures extending through the top surface of the securing area to the bottom surface of the securing area, and each of the apertures having one or more flanges projecting inwardly into the aperture. The door handle assembly further having a plurality of removable securing devices. One or more of the flanges of each of the apertures overlap an outer diameter of the removable securing device and retains the removable securing devices within each of the apertures.

In some embodiments, the grasping area and the securing area may be coupled together by a plurality of connecting members spanning from a first end of the door handle assembly to a second end of the door handle assembly. Further, a first connecting member of the connecting members may be disposed at the first end of the door handle assembly, a second connecting member of the connecting members may be interposed between the first end of the door handle assembly and the second end of the door handle assembly, and a third connecting member of the connecting members may be disposed at the second end of the door handle assembly.

In some embodiments, the grasping area may further include a cavity and a grasping surface.

In some embodiments, one or more of the flanges may be pliable. In some embodiments, one or more of the flanges may be continuous and extend from an inner periphery of each aperture. In other embodiments, one or more of the flanges may be discontinuous and extend from a portion of an inner periphery of each aperture, such that each discontinuity along the inner periphery may create one or more slots.

In some embodiments, one or more of the flanges may be parallel to the top surface and the bottom surface of the securing area. In other embodiments, one or more of the flanges may project from a first distance from the bottom surface towards a second distance from the bottom surface, wherein the second distance is smaller than the first distance.

In some embodiments, each aperture may further include a countersink projecting inwardly from an outer diameter to an inner diameter, the one or more flanges project from adjacent the inner diameter of the countersink.

In some embodiments, the door handle assembly may be made of injection molded plastics. In other embodiments, the door handle assembly may be 3D printed.

Generally, in yet another aspect, a door handle assembly is taught. The door handle assembly has a first end, a second end, a grasping area, and a securing area. The grasping area and the securing area are coupled together by a plurality of connecting members spanning from the first end to the second end. Further, a first connecting member of the connecting members is disposed at the first end of the door handle assembly, a second connecting member of the connecting members is interposed between the first end of the door handle assembly and the second end of the door handle assembly, and a third connecting member of the connecting members is disposed at the second end of the door handle assembly. The securing area has a top surface, a bottom surface, and a plurality of apertures. Each of the apertures extend through the top surface of the securing area to the bottom surface of the securing area. Further, each of the apertures include a countersink adjacent the top surface, and one or more flanges project inwardly and disposed between the countersink and the bottom surface. Further, the door handle assembly includes a plurality of removable securing devices. One or more of the flanges of each of the plurality of apertures retain each of the plurality of removable securing devices therewithin.

In some embodiments, one or more of the flanges may be parallel to the top surface and the bottom surface of the securing area. In other embodiments, one or more of the flanges may project from a first distance from the bottom surface towards a second distance from the bottom surface, wherein the second distance is smaller than the first distance.

In some embodiments, one or more of the flanges may be discontinuous and extend from a portion of an inner periphery of each aperture. In those embodiments, each discontinuity along the inner periphery may create one or more slots.

Generally, in yet other another aspect, a method of using the door handle assembly is taught. The method includes providing a door handle, the door handle including a first end, a second end, a grasping area, and a securing area. The grasping area and the securing area are coupled together by at least one connecting member spanning from the first end to the second end. The grasping area having a grasping surface, and the securing area having a top surface, a bottom surface, and a plurality of apertures. Each of the apertures extending through the top surface of the securing area to the bottom surface of the securing area. Each of the apertures having one or more flanges projecting inwardly from an inner periphery of the aperture. The method further including providing a plurality of removable securing devices and inserting each of the plurality of removable securing devices into each of the plurality of apertures. Each one or more of the flanges of each of the plurality of apertures configured to removably retain each of the plurality of removable securing devices.

In some embodiments, the method may further include the steps of providing a door and fastening the plurality of removable securing devices retained by one or more of the flanges of each aperture to the door.

In some embodiments, the step of providing the door handle may include injection molding the door handle.

In some embodiments, one or more of the flanges may be discontinuous about the inner periphery of the aperture, such that each discontinuity along the inner periphery may create one or more slots.

In some embodiments, one or more flanges may project inwardly at an angle relative to the inner periphery of the aperture.

It should be appreciated that all combinations of the foregoing concepts and additional concepts discussed in greater detail below provided such concepts are not mutually inconsistent are contemplated as being part of the subject matter disclosed herein. In particular, all combinations of claimed subject matter appearing at the end of this disclosure are contemplated as being part of the subject matter disclosed herein.

BRIEF DESCRIPTION OF THE DRAWINGS

In the drawings, like reference characters generally refer to the same parts throughout the different views. Also, the drawings are not necessarily to scale, emphasis instead being generally placed upon illustrating the principles of the embodiments depicted.

DETAILED DESCRIPTION

Figure 1A:
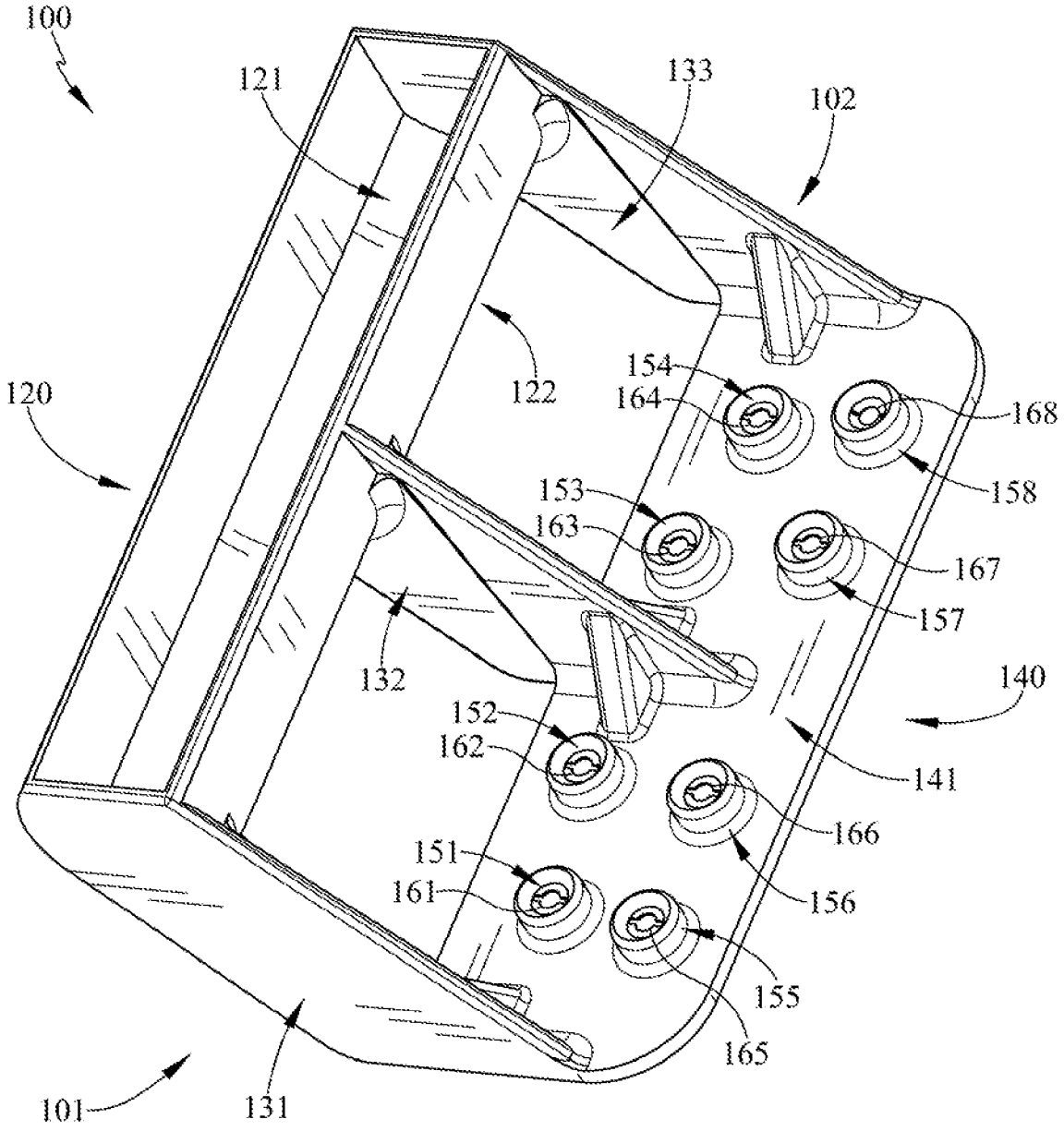
FIG. 1A is a perspective view of a door handle according to one embodiment herein.

It is to be understood that the embodiments are not limited in their application to the details of construction and the arrangement of components set forth in the following description or illustrated in the drawings. Other embodiments are possible and may be practiced or carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected" and "coupled" and variations thereof herein are used broadly and encompass direct and indirect connections and couplings. In addition, the terms "connected" and "coupled" and variations thereof are not restricted to physical or mechanical connections or couplings.

Referring initially to FIG. 1A, a perspective view of a door handle 100 according to one embodiment herein is illustrated. The door handle 100 may have one or more connecting members between a grasping area 120 and a securing area 140. In the embodiments shown, the door handle 100 is comprised of the grasping area 120 and the securing area 140 coupled together by a first connecting member 131, a second connecting member 132, and a third connecting member 133. The first connecting member 131 may be disposed on a first end 101 of the door handle 100, the third connecting member 133 may be disposed on a second end 102 of the door handle 100, and the second connecting member 132 may be interposed therebetween.

The grasping area 120 has a cavity 121 and a grasping surface 122. The cavity 121 is concave and reduces the amount of material needed to manufacture the door handle 100. The grasping surface 122 enables a user comfortably grip the door handle 100 and is disposed on an underside of the cavity 121. The user may insert two fingers between the first connecting member 131 and the second connecting member 132, and insert two other fingers between the second connecting member 132 and the third connecting member 133. The user may then firmly hold onto the grasping surface 122.

The securing area 140 has a top surface 141 with a plurality of apertures 151-158, each of the apertures 151-158 may be circular and raised a pre-determined height from the top surface 141. The pre-determined height may be based on various factors including door size and door manufacturer need. Each of the apertures 151-158 may have one or more flanges 161-168 located therewithin. Each of the flanges 161-168 may be pliable and may be flat or angled, which will be discussed further hereinafter with respect to FIGS. 3A-3B. Further, each of the apertures 151-158 may include a countersink 171-178, which will be discussed further hereinafter with respect to FIGS. 3A-3B.

Figure 1B:
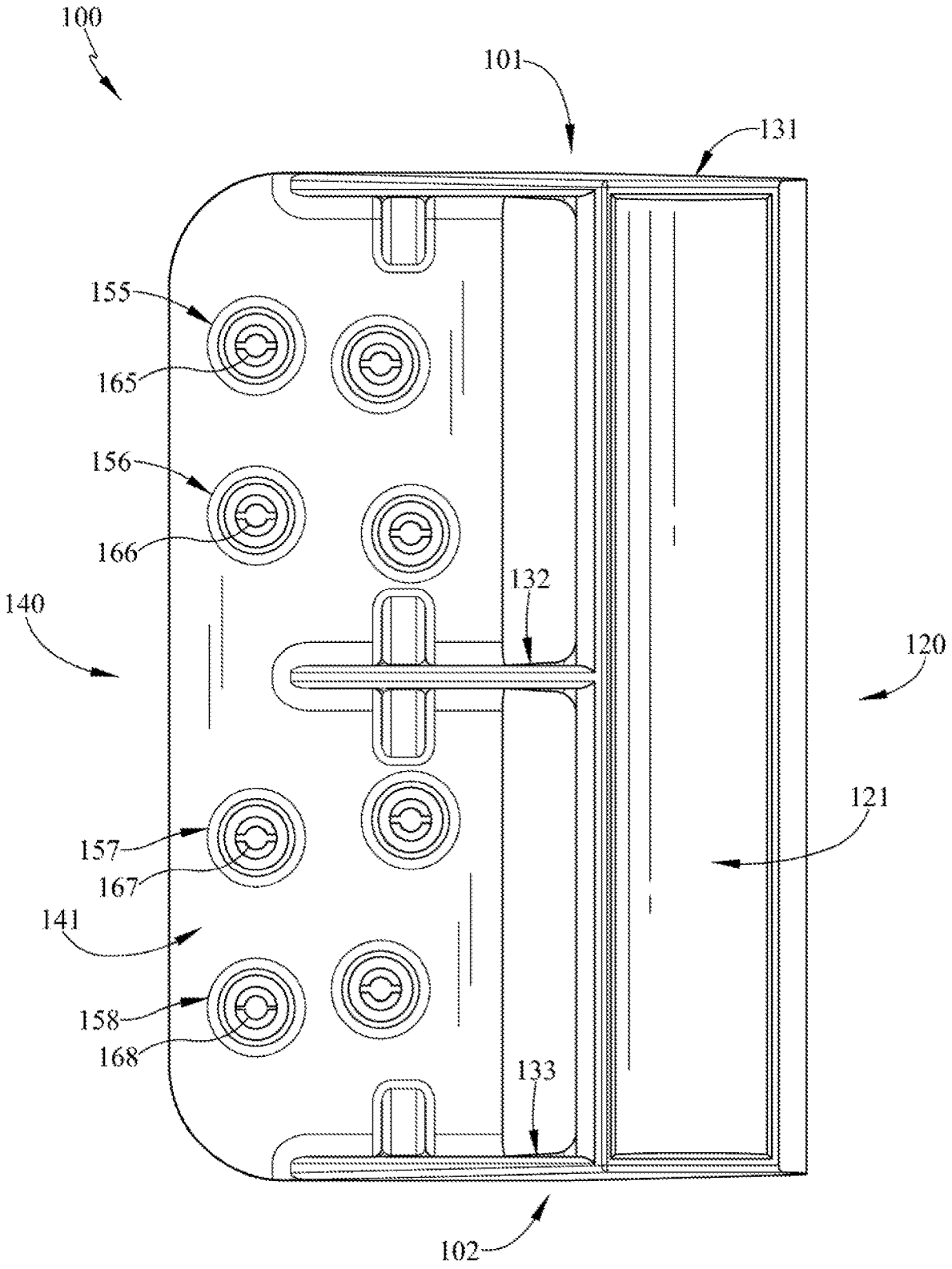
FIG. 1B is a top view of the door handle according to FIG. 1A.

FIG. 1B is a top view of the door handle 100 of FIG. 1A. This view illustrates each aperture 151-158 and each of the flanges 161-168. Each of the apertures 151-158 and their respective flanges 161-168 may be the same shape, or they may be different shapes. Each flange 161-168 may be, but is not limited to, one circular portion or two semicircular or arcuate portions. Each of the flanges 161-168 are radial and project inwardly into each aperture 151-158. In the shown embodiments, each of the flanges 161-168 project inwardly for a portion of an inner periphery 151*a*-158*a* of each of the apertures 151-158. The discontinuity due to the portion may create one or more slots along the inner periphery 151*a*-158*a*. In other embodiments, each of the flanges 161-168 project inwardly for an entire portion of the inner periphery 151*a*-158*a* of each of the apertures 151-158.

The securing area 140 may have one or more of the apertures 151-158. The top surface 141 of the securing area 140 is illustrated as having eight apertures 151-158, but this is not meant to be limiting. The top surface 141 of the securing area 140 may have either four apertures or ten apertures, and still function in a substantially similar way. Additionally, the arrangement of the apertures 151-158 on the top surface 141 of the securing area 140 is illustrated as having a first column of apertures 151-154 (not referenced with numbers in FIG. 1B) and a second column of apertures 155-158, but this is not meant to limiting. The number of apertures and their configuration on the top surface 141 of the securing area 140 may be a function of a particular door height, width, weight, etc.

Figure 2A:
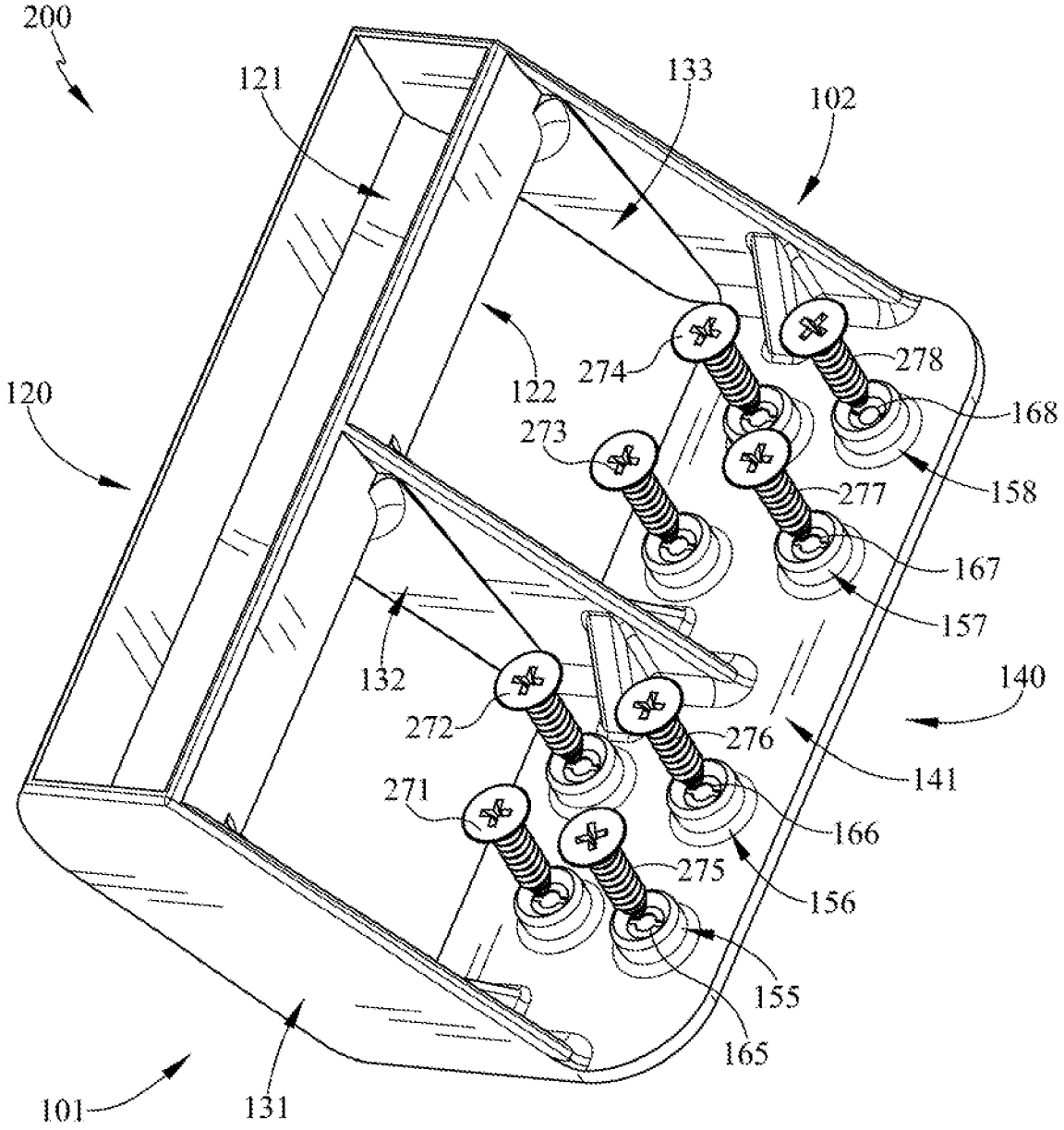
FIG. 2A is perspective view of a door handle assembly according to one embodiment herein.

FIG. 2A is a perspective view of a door handle assembly 200 according to one embodiment herein. The door handle assembly 200 of FIG. 2A includes various types of removable securing devices, for example screws. Other securing devices, such as nails or the like, may be used, but for the sake of brevity, screws 271-278 will be used for reference. The length and diameter of the screws 271-278 may depend on the size of the apertures 151-158, but are typically 0.75" long and 0.125" in diameter. For example, a larger door may require larger apertures and larger screws to ensure the door handle assembly 200 is sufficiently secured to a door. In this example, the screws 271-278 may be 1.00" long and 0.25" in diameter. Although the screws 271-278 are illustrated as crosshead screws, they may be flathead screws, square, or pozidriv screws. Preferably, the screws 271-278 may be self-tapping to prevent the need for drilling a pilot hole in the door before securing the door handle assembly 200. These variations apply equally to other types of removable securing devices. Each aperture 151-158 may be configured to receive each screw 271-278, and each flange 161-168 may be configured to overlap an outer diameter of the screw 271-278, respectively. Although not shown, it should be understood in some embodiments, the fastener may interfere with the inner periphery of the apertures that may not contain inwardly projecting flanges. Further, in some embodiments, the fastener may interfere with one or more flanges and the inner periphery of each apertures in order to be retained therein.

Each flange 161-168 may be pliable and may retain each screw 271-278, or other removable securing devices, by receiving each screw 271-278 through each aperture 151-158. In some embodiments, each screw 271-278 may be turned/rotated into axial engagement with the one or more flanges, such that a portion of each screw 271-278 is received by each flange 161-168. In other embodiments, each screw 271-278 may be forcibly pushed axially through each aperture 151-158 with reduced or without rotation, such that a portion of each screw 271-278 is received by each flange 161-168. The flanges 161-168 may retain each screw 271-278, or a portion thereof, until they are forcibly removed. The door handle assembly 200 may be packaged and shipped in this configuration, such that a door manufacturer need only remove the door handle assembly from its package and secure the screws 271-278, or other removable securing devices, to the door through each aperture 151-158.

Figure 2B:
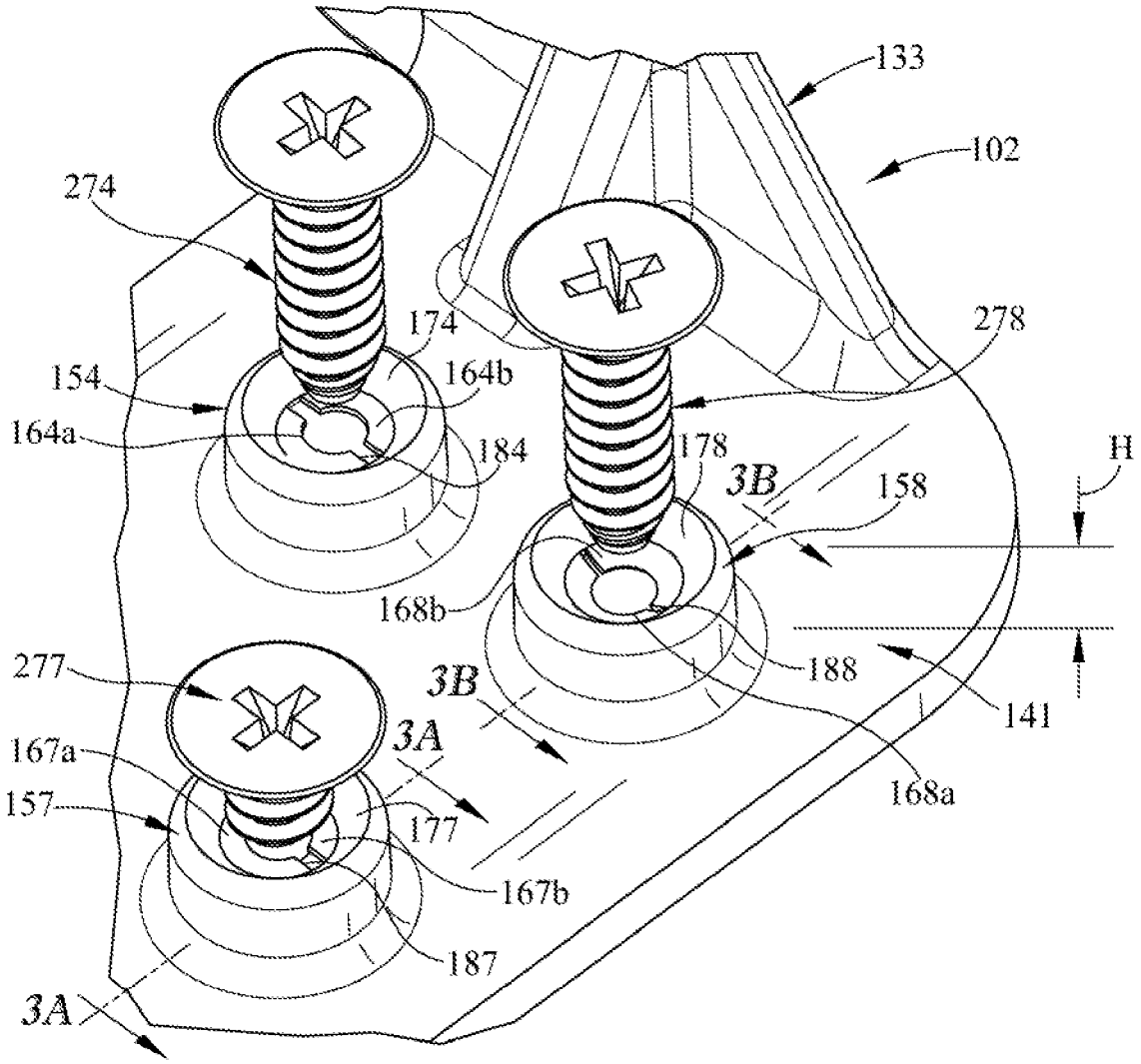
FIG. 2B is a close-up, perspective view of a plurality of apertures and one or more flanges according to FIG. 2A.

FIG. 2B is a close-up, perspective view of the apertures and the flanges according to FIG. 2A. In some embodiments, each of a fourth aperture 154, a seventh aperture 157, and an eighth aperture 158 are circular and raised a pre-determined height H from the top surface 141 of the securing area 140. In other embodiments, the fourth aperture 154, the seventh aperture 157, and the eighth aperture 158 may each be a different shape and raised to various heights.

In some embodiments, each of a fourth flange 164, a seventh flange 167, and an eighth flange 168 are made of two semicircular or arcuate portions 164*a*-164*b*, 167*a*-167*b*, and 168*a*-168*b*, respectively. Each flange 164, 167, and 168 may be radial and project inwardly for a portion of an inner periphery 154*a*, 157*a*, and 158*a* of each of the apertures 154, 157, and 158, respectively. In this embodiment, a slot 184, 187, and 188, respectively, is created between the two semicircular or arcuate portions 164*a*-164*b*, 167*a*-167*b*, and 168*a*-168*b*, respectively. In other embodiments, each of the fourth flange 164, the seventh flange 167, and the eighth flange 168 are made of one circular portion. Each of the flanges 161-168 may be radial and project inwardly for an entire portion of the inner periphery 151*a*-158*a* of each of the apertures 151-158. Regardless, each flange 161-168 is pliable and may retain a removable securing device, or a portion thereof. "Pliable" refers to the ability to easily bias each of the flanges 161-168 in one or more directions. This pliability allows each of the flanges 161-168 to be biased time and time again without breaking.

In some embodiments, the removable securing devices may be screws. Illustrated is a fourth screw 274, a seventh screw 277, and an eighth screw 278. In some embodiments, each screw may be a crosshead screw that is threaded and self-tapping. In other embodiments, each screw may be a nail that is retained by a frictional force between the nail and each flange 164, 167, and 168. However, it is preferable that a threaded screw, such as the fourth screw 274, the seventh screw 277, and the eighth screw 278, be used. This would allow the fourth flange 164, the seventh flange 167, and the eighth flange 168 to retain a portion of the threaded screw.

Each of the fourth aperture 154, the seventh aperture 157, and the eighth aperture 158 may include a fourth countersink 174, a seventh countersink 177, and an eighth countersink 178, respectively. Each of the fourth countersink 174, the seventh countersink 177, and the eighth countersink 178 will be discussed further hereinafter with respect to FIGS. 3A-3B.

In some embodiments, each of the flanges and portions thereof may be flat and parallel to the top surface 141 of the securing area 140, such as the fourth flange 164 and the seventh flange 167 (discussed further hereinafter with respect to FIG. 3A). In other embodiments, each of the flanges and portions thereof may angled, such as the eighth flange 168 (discussed further hereinafter with respect to FIG. 3B). The illustrated apertures, flanges, and removable securing devices, i.e. screws, are for exemplary purposes only and not meant to be limiting.

Figure 3A:
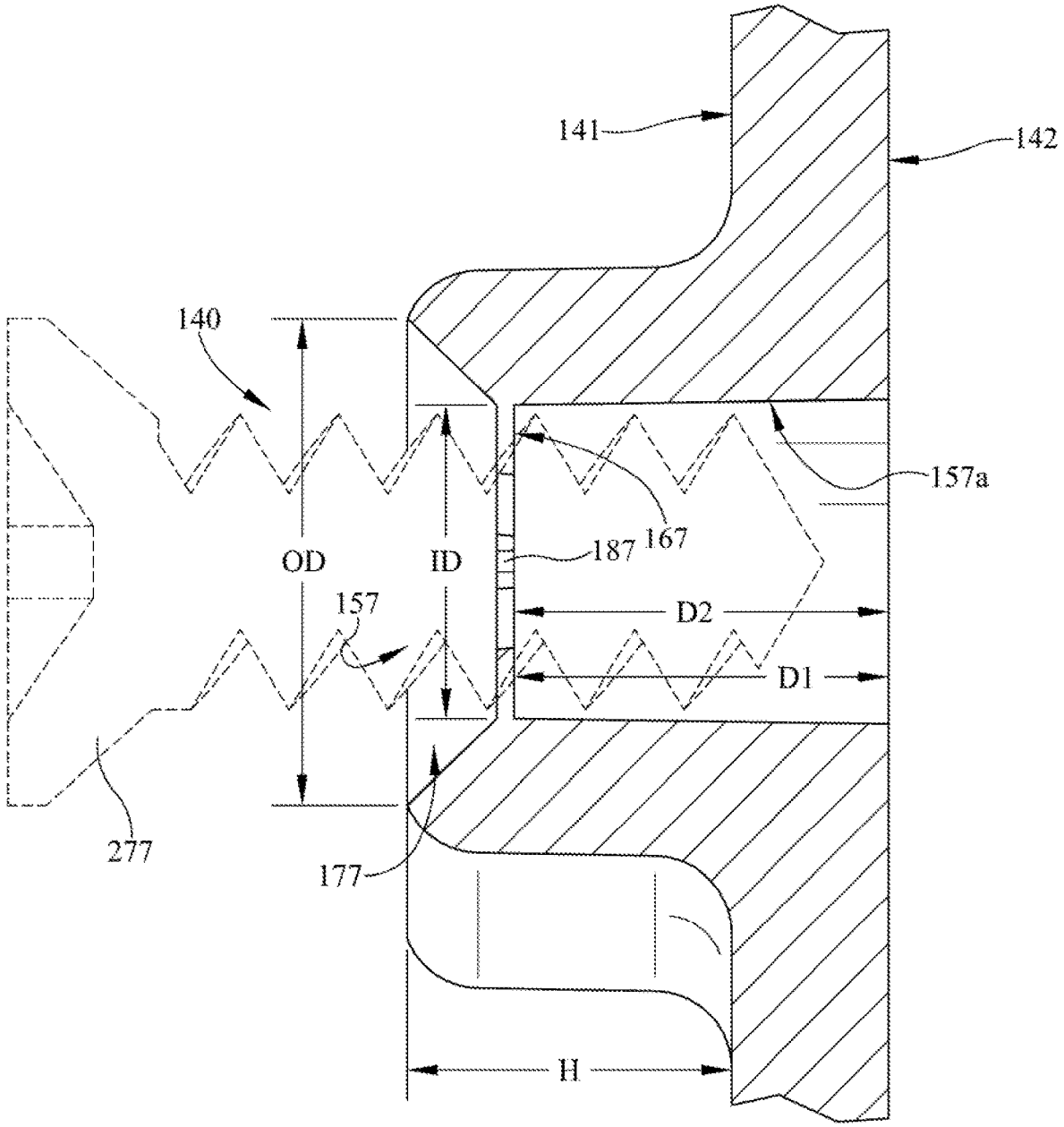
FIG. 3A is a sectional view of an aperture and one of the one or more flanges according to FIG. 2B taken along line 3A-3A, illustrating the radial interference of the fastener being retained by the one or more flanges in an overlapping engagement.

FIG. 3A is a sectional view of the seventh aperture 157 and the seventh flange 167 according to FIG. 2B taken along long 3A-3A. The seventh aperture 157 is circular and raised a pre-determined height H from the top surface 141 of the securing area 140, and allows a removable securing device to pass through the seventh aperture 157 toward a bottom surface 142 of the securing area 140. In this embodiment, the seventh flange 167 is illustrated as being flat, such that it is parallel to both the top surface 141 and the bottom surface 142 of the securing area 140. As illustrated in FIG. 3A, the fastener 277 may be retained by the aperture 157 and/or one or more flanges 16. During assembly of the fasteners with the apertures, in some embodiments, the fastener may be positioned axially within the aperture not to extend beyond the bottom surface 142 to reduce contact with the end of the fastener (e.g. the point opposite the screw head).

Further, the seventh aperture 157 may include the seventh countersink 177. The seventh countersink 177 adjacent the top surface 141 of the securing area 140. In the shown embodiment, the first portion 167*a* of the seventh flange 167 and the second portion 167*b* of the seventh flange 167 project inwardly. The seventh flange 167 may be disposed between the seventh countersink 177 and the bottom surface 142 of the securing area. Although the seventh flange 167 is shown as being disposed at a first distance D1 from the bottom surface 142 of the securing area 140, the seventh flange 167 may be disposed anywhere along the first distance D1. For example, the seventh flange 167 may be disposed adjacent an outer diameter OD or an inner diameter ID of the seventh countersink 177. As another example, the seventh flange 167 may be disposed adjacent to the bottom surface 142 of the securing area 140.

Even further, additional flanges may be disposed at any point along the first distance D1 or the second distance D2. In some embodiments, the seventh flange 167 is comprised of a first portion 167*a* and a second portion 167*b* and the discontinuity on the inner periphery 157*a* of the seventh aperture 157 between the first portion 167*a* and the second portion 167*b* creates a seventh slot 187. The seventh slot 187 may allow for easy insertion of a removable securing device into the seventh aperture 157. In other embodiments, the flange 167 is one portion that extends continuously from the inner periphery 157*a* of the seventh aperture 157.

The seventh flange 167 is pliable and retains a portion of the removable securing device, such that the removable securing device will remain in door handle assembly until it is forcibly removed. The seventh flange 167 may achieve this by providing a resistive force on the removable securing device. In some embodiments the resistive force may be friction between the removable securing device and the seventh flange 167 caused by overlapping portions of the removable securing device and the seventh flange 167. For example, the seventh flange 167 may receive a portion of a threaded screw when a coefficient of kinetic friction for the seventh flange 167 is overcome by a force applied to the threaded screw. Further, the seventh flange 167 may retain the portion of the threaded screw when a coefficient of static friction for the seventh flange 167 is not overcome by the force applied the threaded screw, such as when the door handle assembly is shipped.

Figure 3B:
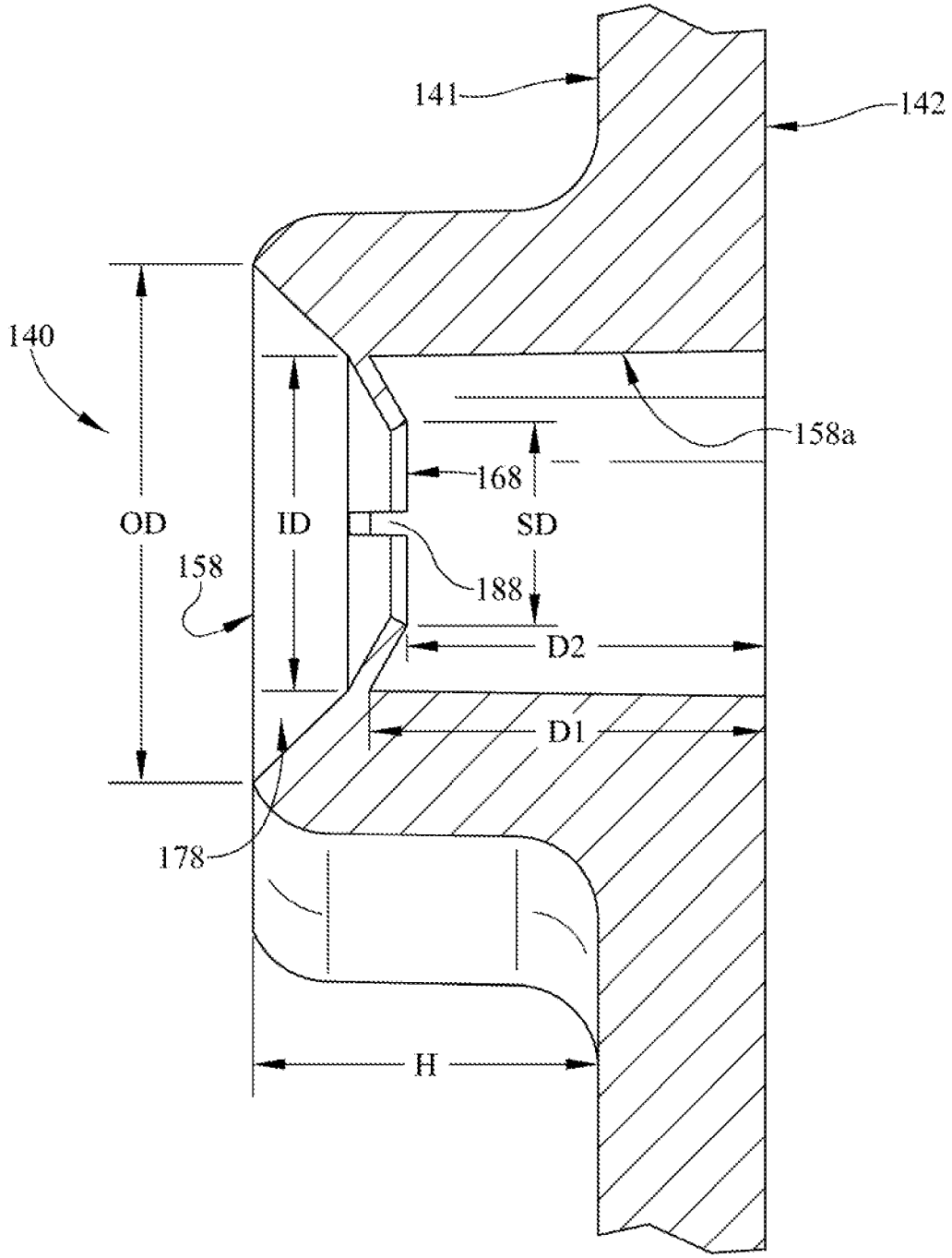
FIG. 3B is a sectional view of an aperture and one of the one or more flanges according to FIG. 2B taken along line 3B-3B.

FIG. 3B is a sectional view of the eighth aperture 158 and the eighth flange 168 according to FIG. 2B taken along line 3B-3B. The eighth aperture 158 is circular and raised a pre-determined height H from the top surface 141 of the securing area 140, and allows a removable securing device to pass through to a bottom surface 142 of the securing area 140. The eighth aperture 158 include the eighth flange 168. The eighth flange 168 may project from the first distance D1 from the bottom surface 142 towards the second distance D1 from the bottom surface, wherein the second distance D2 is smaller than the first distance D1.

Further, the eighth aperture 158 may include the eighth countersink 178. The eighth countersink 178 is also adjacent the top surface 141 of the securing area 140, and is substantially similar to the seventh countersink 177. The eighth countersink 178 projects inwardly from an outer diameter OD to an inner diameter ID. In the shown embodiment, the first portion 168*a* of the eighth flange 168 and the second portion 168*b* of the eighth flange 168 project inwardly. The eighth flange 168 may be disposed between the eighth countersink 178 and the bottom surface 142 of the securing area. Although the eighth flange 168 is shown as being disposed at a second distance D2 from the bottom surface 142 of the securing area 140, the eighth flange 168 may be disposed anywhere along the second distance D2. For example, the eighth flange 168 may be disposed adjacent an outer diameter OD or an inner diameter ID of the eighth countersink 178. As another example, the eighth flange 168 may be disposed adjacent to the bottom surface 142 of the securing area 140.

The difference between the first distance D and the second distance D2 is not to scale and not meant to be limiting. This difference may depend on a door size, weight, etc.

The eighth flange 168 may be disposed at a location closer to the bottom surface 142. Further, additional flanges may be disposed at any point along the first distance D1 or the second distance D2. In some embodiments, the eighth flange 168 is comprised of a first portion 168*a* and a second portion 168*b* and the discontinuity on the inner periphery 158*a* of the eighth aperture 158 between the first portion 168*a* and the second portion 168*b* creates an eighth slot 188. The eighth slot 188 may allow for easy insertion of a removable securing device into the seventh aperture 157. In other embodiments, the flange 167 is one portion that extends continuously from the inner periphery 157*b* of the eighth aperture 158.

The eighth flange 168 may be pliable and retains a portion of the removable securing device, such that the removable securing device will remain in place when the door handle assembly is shipped. The eighth flange 168 may achieve this by providing a resistive force on the removable securing device. In some embodiments, the resistive force is friction between the removable securing device and the eighth flange 168. For example, the eighth flange 168 may receive a portion of a threaded screw when a coefficient of kinetic friction for the eighth flange 168 is overcome by a force applied to the threaded screw. Further, the eighth flange 168 may retain the portion of the threaded screw when a coefficient of static friction for the eighth flange 168 is not overcome by the threaded screw, such as when the door handle assembly is shipped. Additionally, the eighth flange 168 may provide a stronger resistive force than the seventh flange 167 due to the angle formed between the eighth flange 168 and the removable securing device. Thus, a stronger force may be required to remove the removable securing device.

Both the seventh flange 167 and the eighth flange 168 are pliable to allow the removable securing device to be received by the seventh aperture 157 the eighth aperture 158, respectively. In some embodiments, the door handle may have only flat flanges, such as the seventh flange 167. In other embodiments, the door handle may have only angled flanges, such as the eighth flange 168. In some other embodiments, the door handle may have flanges that are both flat and angled, such as the seventh flange 167 and the eighth flange 168 depicted in FIG. 2B. Both the seventh flange 167 and the eighth flange 168 may be used to retain the removable securing device, or a portion thereof, while the door handle assembly is packaged and shipped, and while the door manufacturer installs the door handle assembly.

Figure 4:
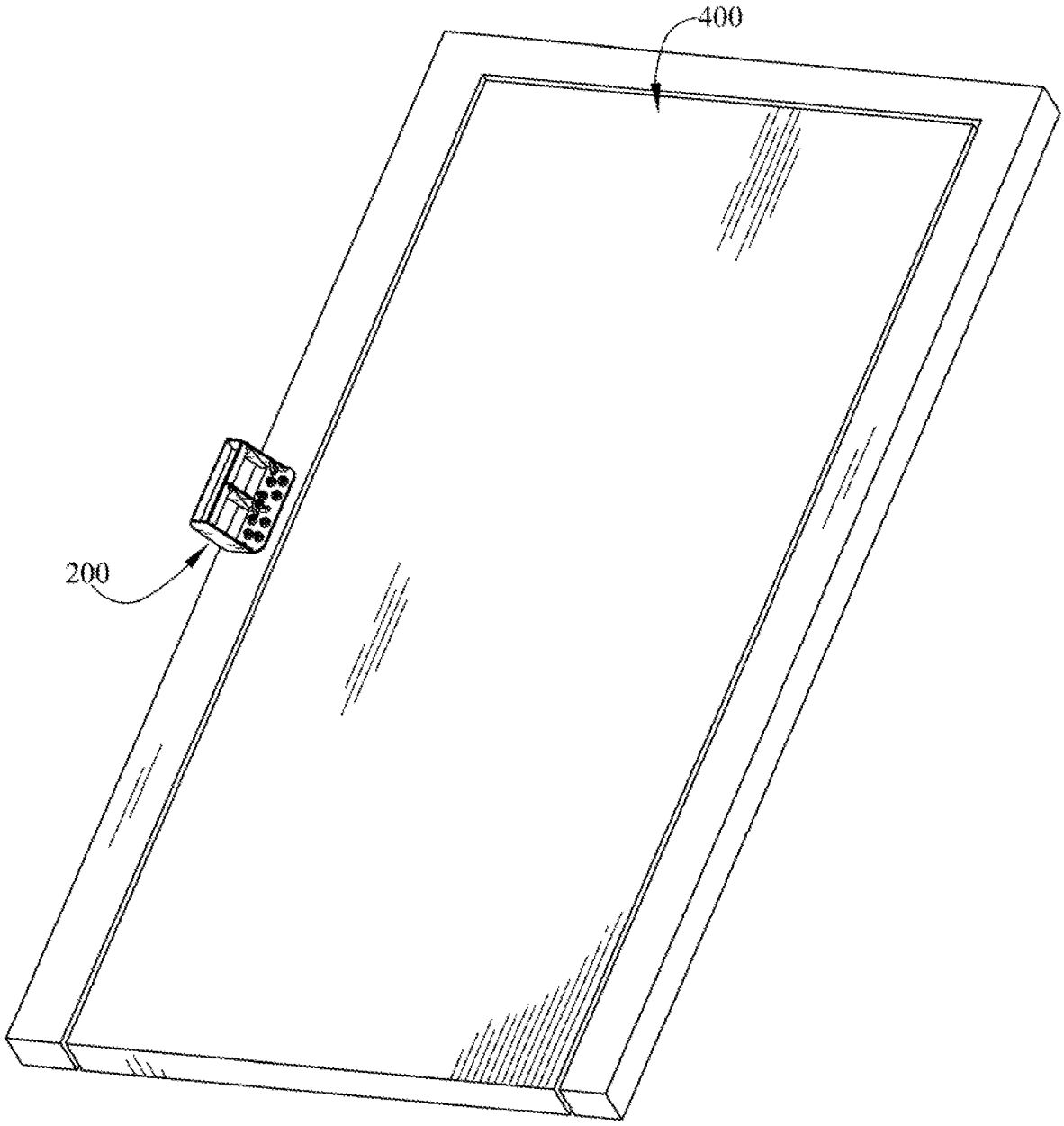
FIG. 4 is an environmental, perspective view of the door handle assembly of FIG. 2A secured to one or more portions of a door or object, more specifically in one embodiment to a door frame or packaging surrounding a door.

FIG. 4 is an environmental, perspective view of the door handle assembly 200 of FIG. 2A secured to a door, frame, and/or door packaging 400. It should be understood that the door handle assembly 200 may be secured to a variety of objects. A user may be provided a door handle assembly 200 and a door 400. When providing the door handle assembly 200, a plurality of removable securing devices, such as screws 271-278, may be inserted into each of the plurality of apertures 151-158. Each of the plurality of removable securing devices may be retained by one or more flanges 161-168 within each of the apertures 151-158, as described above. One or more door handle assemblies 200 may then be fastened to the door 400, or more specifically to the door frame in one embodiment. This enables a door manufacturer to pick up and maneuver the door 400 without causing any damage to the door 400 or any other objects in the door manufacturing facility. Further, the door handle assembly 200 may remain secured to the door 400 until it is installed in a residential home or a commercial building.

One of skill in the art will recognize that the door handle 100 disclosed herein may be made by a variety of different methods from a variety of materials. In some embodiments, the door handle 100 may be manufactured via injection molding. If the door handle 100 is injection molded, then the material may be, but is not limited to, elastomers, thermosetting polymers, polyurethane, or any other polymer. In other embodiments, the door handle 100 may be manufactured via 3D printing. If the door handle 100 is 3D printed, then the material may be, but is not limited to powders, elastomers, thermosetting polymers, polyurethane, or any other polymer.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

It should also be understood that, unless clearly indicated to the contrary, in any methods claimed herein that include more than one step or act, the order of the steps or acts of the method is not necessarily limited to the order in which the steps or acts of the method are recited.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B," when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least of A and B" (or, equivalently, "at least one of A or B," or equivalently, "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively as set forth in the United States Patent Office Manual of Patent Examining Procedures, Section 2111.03.

The foregoing description of several methods and embodiments have been presented for purposes of illustration. It is intended to be exhaustive or to limit the precise steps and/or forms disclosed, and obviously many modifications and variations are possible in light of the above teaching. It is intended that the scope and all equivalents be defined by the claims appended hereto.

What is claimed:

1. A door handle assembly, comprising:

a grasping area of the door handle assembly and a securing area of the door handle assembly to secure the grasping area to a door, the securing area attached to the grasping area by a plurality of connecting members;

the securing area having a top surface, a bottom surface, and a plurality of apertures;

wherein the plurality of connecting members include a first, second and third connecting member directly extending from the grasping area to the securing area, the first connecting member disposed on a first end of the door handle assembly, the third connecting member disposed on a second end of the door handle assembly distal from the first end of the door handle assembly and the second connecting member interposed between the first connecting member and the third connecting member;

the plurality of apertures on the securing area including a first plurality of apertures located between the first connecting member and the second connecting member and a second plurality of apertures located between the second connecting member and the third connecting member;

each of the plurality of apertures having:

a countersink;

an inner sidewall extending from the countersink to the bottom surface of the securing area;

a flange positioned between the countersink and a top end of the inner sidewall adjacent to the top surface of the securing area, the flange extending inwardly from the inner sidewall; and a plurality of removable securing devices, wherein one or more of the flanges of each of the apertures overlap an outer diameter of the removable securing device and retains the removable securing devices within each of the apertures.

2. The door handle assembly of claim 1, wherein the grasping area further includes a cavity and a grasping surface.

3. The door handle assembly of claim 1, wherein one or more of the flanges are pliable.

4. The door handle assembly of claim 1, wherein one or more of the flanges are parallel to the top surface and the bottom surface of the securing area.

5. The door handle assembly of claim 1, wherein one or more of the flanges project from a first distance from the bottom surface towards a second distance from the bottom surface, wherein the second distance is smaller than the first distance.

6. The door handle assembly of claim 1, wherein each aperture includes the countersink which projects inwardly from an outer diameter to an inner diameter, the one or more flanges project from adjacent the inner diameter of the countersink.

7. The door handle assembly of claim 1, wherein one or more of the flanges are continuous.

8. The door handle assembly of claim 1, wherein one or more of the flanges are discontinuous.

9. The door handle assembly of claim 8, wherein each discontinuity creates one or more slots through which extends one of the securing devices.

10. The door handle assembly of claim 1, wherein the door handle assembly is made of injection molded plastics.

11. A door handle assembly, comprising:

a grasping area having a first end and a second end and a securing area, wherein the grasping area and the securing area are coupled together by a plurality of connecting members extending between the grasping area and the securing area of the door handle assembly, the connecting members positioned between the first end and the second end;

wherein the plurality of connecting members include a first, second and third connecting member directly extending from the grasping area to the securing area, the first connecting member disposed on a first end of the door handle assembly, the third connecting member disposed on a second end of the door handle assembly distal from the first end of the door handle assembly and the second connecting member interposed between the first connecting member and the third connecting member;

the grasping area having a grasping surface forming a door handle;

the securing area having a top surface, a bottom surface, and a plurality of apertures;

each of the plurality of apertures extending through the top surface of the securing area to the bottom surface of the securing area;

wherein each of the apertures includes:

a countersink adjacent the top surface, an inner sidewall extending from the countersink to the bottom surface of the securing area; and one or more flanges projecting inwardly from the inner sidewall, the one or more flanges disposed between the countersink and the bottom surface;

wherein the one or more flanges includes a first arcuate flange and a second arcuate flange extending inwardly and being discontinuous around the aperture forming a slot;

the plurality of apertures on the securing area including a first plurality of apertures located between the first connecting member and the second connecting member and a second plurality of apertures located between the second connecting member and the third connecting member;

and a plurality of removable securing devices;

wherein for each of the one or more of the flanges, a slot of each of the plurality of apertures formed between the first arcuate flange and the second arcuate flange retains one of the plurality of removable securing devices by engaging at least a portion of a thread of the removable securing device within the respective aperture therewithin.

12. The door handle assembly of claim 11, wherein one or more of the flanges are parallel to the top surface and the bottom surface of the securing area.

13. The door handle assembly of claim 11, wherein one or more of the flanges project from a first distance from the bottom surface towards a second distance from the bottom surface, wherein the second distance is smaller than the first distance.

14. A door handle assembly, comprising:

a grasping area connected to a securing area by a plurality of connecting members, the grasping area having a first end and a second end, the plurality of connecting members positioned between the first end to the second end;

wherein the plurality of connecting members includes a first connecting member positioned at the first end of the grasping area and directly connecting the first end of the grasping area to the securing area, a third connecting member positioned at the second end of the grasping area and directly connecting the third end of the grasping area to the securing area, and a second connecting member positioned between the first end and the second end of the grasping area and directly extending between the grasping area and the securing area;

the securing area having a top surface and a bottom surface, the first connecting member, second connecting member and third connecting member attached at least to the top surface of the securing area;

the securing area having a first plurality of apertures and a second plurality of apertures wherein both the first plurality of apertures and the second plurality of apertures extending from the top surface of the securing area to the bottom surface;

each of the plurality of apertures having:

a countersink adjacent a top surface and a side wall forming the aperture between the top surface and the bottom surface of the securing area, and at least one flange extending inwardly from the sidewall, wherein the at least one flange is pliable;

a plurality of securing devices, each securing device having:

a thread, and retained in a particular one of the plurality of apertures, the flange of the particular one of the plurality of apertures engaging the at least one thread of the securing device and being retained within the aperture of the door handle assembly securing area.

* * * * *